US009839085B2

(12) United States Patent
Na et al.

(10) Patent No.: US 9,839,085 B2
(45) Date of Patent: Dec. 5, 2017

(54) LIGHTING CONTROL APPARATUS USING WIRE AND WIRELESS INTEGRATED DIMMING CIRCUIT

(71) Applicant: LG INNOTEK CO., LTD., Seoul (KR)

(72) Inventors: Ho Jun Na, Seoul (KR); Young Woo Yang, Seoul (KR); Nak Gwon Choi, Seoul (KR); Han Yong Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/387,853

(22) Filed: Dec. 22, 2016

(65) Prior Publication Data

US 2017/0188429 A1 Jun. 29, 2017

(30) Foreign Application Priority Data

Dec. 24, 2015 (KR) ..... 10-2015-0186760
Dec. 24, 2015 (KR) ..... 10-2015-0186795

(51) Int. Cl.
*H05B 33/08* (2006.01)
*H05B 37/02* (2006.01)

(52) U.S. Cl.
CPC ..... *H05B 33/0845* (2013.01); *H05B 33/0857* (2013.01); *H05B 33/0887* (2013.01); *H05B 37/0272* (2013.01)

(58) Field of Classification Search
CPC .... H05B 33/02; H05B 33/08; H05B 33/0809; H05B 33/0833; H05B 33/0842; H05B 33/0845; H05B 33/0857; H05B 33/0887; H05B 37/02; H05B 37/0245; H05B 37/0272
See application file for complete search history.

(56) References Cited

U.S. PATENT DOCUMENTS

2011/0204778 A1* 8/2011 Sadwick ..... H05B 33/0827 315/34
2013/0175931 A1* 7/2013 Sadwick ..... H05B 37/0245 315/158
2014/0265935 A1* 9/2014 Sadwick ..... H05B 33/0815 315/307
2015/0054420 A1* 2/2015 Hiramatu ..... H05B 33/0815 315/210

* cited by examiner

*Primary Examiner* — Jason M Crawford
(74) *Attorney, Agent, or Firm* — LRK Patent Law Firm

(57) ABSTRACT

A lighting control apparatus using a wire and wireless integrated dimming circuit includes: an input power supply unit; a converter for converting input power to lighting unit supply power; a lighting unit applied with the lighting unit supply power to emit light; a wired module for inputting a wired dimming signal for controlling the lighting unit; a wireless module for inputting a wireless dimming signal for controlling the lighting unit; and a transform module for receiving the wired dimming signal or the wireless dimming signal, transforming the received dimming signal to a preset power, and applying the transformed power to the converter, in which the wired module and the wireless module are connected in parallel, selectively receive the wired dimming signal or the wireless dimming signal, and applies the received dimming signal to the transform module.

17 Claims, 10 Drawing Sheets

LIGHTING CONTROL APPARATUS USING WIRE AND WIRELESS INTEGRATED DIMMING CIRCUIT

CROSS REFERENCE TO RELATED APPLICATION(S)

The present application claims the benefit of Korean Patent Application No. 10-2015-0186760 and No. 10-2015-0186795, filed in the Korean Intellectual Property Office on Dec. 24, 2015 and Dec. 24, 2015, respectively, and the entire contents of which are incorporated herein by reference.

BACKGROUND OF THE INVENTION

1. Field of the Invention

The present invention relates to a lighting control apparatus using a wire and wireless integrated dimming circuit, the apparatus including: an input power supply unit; a converter for converting input power to lighting unit supply power; a lighting unit applied with the lighting unit supply power to emit light; a wired module for inputting a wired dimming signal for controlling the lighting unit; a wireless module for inputting a wireless dimming signal for controlling the lighting unit; and a transform module for receiving the wired dimming signal or the wireless dimming signal, transforming the received dimming signal to a preset power, and applying the transformed power to the converter, in which the wired module and the wireless module are connected in parallel, selectively receive the wired dimming signal or the wireless dimming signal, and applies the received dimming signal to the transform module.

2. Description of Related Art

A light emitting diode (LED) is a kind of semiconductor device for converting electrical energy into light. The LED has advantages of low power consumption, semi-permanent lifespan, fast response time, safety and eco-friendliness compared with existing light sources such as a fluorescent lamp, an incandescent lamp and the like. Particularly, an LED lighting apparatus may carry out various performances by controlling the order of turning on and off LEDS installed in a plurality of arrays, colors and brightness of emitted light, and the like.

Therefore, a lot of studies are under progress to substitute LEDs for a conventional light source, and use of the LEDs as a light source of a variety of lighting apparatuses used indoor or outdoor, such as lamps, LCD devices, electronic signboards, street lamps and the like, is on the rise. Particularly, the LEDS are used for general lighting of indoor interiors, stage lighting for making a specific atmosphere, advertisement lighting, landscape lighting and the like.

The lighting apparatus may be installed on an outer wall of a building, in a park, on the street as a street lamp, on a bridge rail, in a theater and the like as a landscape lighting apparatus, and the size and applied system may vary according to the applied purpose, target or position. That is, a lighting apparatus for an outer wall of a building is used to be simply displayed on the outer wall of a building in the shape of a stripe just for blinking in an single or combined color, and a lighting apparatus installed in a park, in a street lamp, on a bridge rail or the like is irregularly installed according to the shape of a target object to blink while changing colors.

Meanwhile, LED lighting is rapidly distributed owing to a long lifespan and high efficiency compared with conventional lighting, and dimmers capable of changing illuminance according to climate change and time are commercialized. Control methods of the dimmers can be divided into wireless communication and wired communication, and particularly, when the wireless communication is used, brightness is adjusted by handling a Dim(+−) line in each driver.

Such a dimmer may use a wired dimming circuit performing a 0 to 10V dimming control through wired communication and a wireless dimming circuit performing a dimming control using wireless communication such as Zigbee or the like. Particularly, in LED dimming, although wired lighting has been constantly used until now, interest and demands on wireless lighting tend to increase recently, and accordingly, wireless lighting products are introduced in the market.

Then, referring to FIG. 1, in order to implement a lighting apparatus using both the wired dimming circuit 160 and the wireless dimming circuit 170, boards including each of the circuits should be separately manufactured. In addition, since the conventionally used wired dimming circuit 160 adopts a complicated circuit using an OP-AMP, there is a problem in that high price and high volume are enforced due to the configuration of the circuit.

Accordingly, in order to solve the disadvantage of inducing increase of unit price and decreasing universality, lighting apparatuses using a wire and wireless integrated dimming circuit are studied diversely to configure a circuit avoiding enlargement and overpopulation of components and support mass-productivity through simple implementation of the circuit.

SUMMARY OF THE INVENTION

Therefore, the present invention has been made in view of the above problems, and it is an object of the present invention to provide a lighting control apparatus using a wire and wireless integrated dimming circuit, which integrates wired dimming (0 to 10V dimming) and wireless dimming (Zigbee dimming) in one circuit by connecting them in parallel for miniaturization and integration of components as described above.

An object of the present invention is to provide a lighting control apparatus using a wire and wireless integrated dimming circuit, which integrates wired dimming (0 to 10V dimming) and wireless dimming (Zigbee dimming) in one circuit for miniaturization and integration of components as described above.

The technical objects to be accomplished by the present invention are not limited to the technical objects mentioned above, and various technical objects may be included within a scope apparent to those skilled in the art.

To accomplish the above objects, according to one aspect of the present invention, there is provided a lighting control apparatus using a wire and wireless integrated dimming circuit, the apparatus comprising: an input power supply unit; a converter for converting input power to lighting unit supply power; a lighting unit applied with the lighting unit supply power to emit light; a wired module for inputting a wired dimming signal for controlling the lighting unit; a wireless module for inputting a wireless dimming signal for controlling the lighting unit; and a transform module for receiving the wired dimming signal or the wireless dimming signal, transforming the received dimming signal to a preset power, and applying the transformed power to the converter, wherein the wired module and the wireless module are connected in parallel, selectively receive the wired dimming signal or the wireless dimming signal, and applies the received dimming signal to the transform module.

In addition, the lighting control apparatus using a wire and wireless integrated dimming circuit according to an embodiment of the present invention further comprises an EMI filter for removing noise of the input power and applying the input power to the converter.

In addition, in the lighting control apparatus using a wire and wireless integrated dimming circuit according to an embodiment of the present invention, the converter includes: a PFC converter; and a fly-back converter.

In addition, in the lighting control apparatus using a wire and wireless integrated dimming circuit according to an embodiment of the present invention, the converter receives the wired dimming signal or the wireless dimming signal and controls dimming of the lighting unit if a necessary driving condition is satisfied.

In addition, in the lighting control apparatus using a wire and wireless integrated dimming circuit according to an embodiment of the present invention, the wired module includes a wired signal input unit for inputting the wired dimming signal. At this point, the wired dimming signal is a 0 to 10V dimming signal.

In addition, in the lighting control apparatus using a wire and wireless integrated dimming circuit according to an embodiment of the present invention, the wired module includes: a first supply power unit; and a power distribution module for distributing supply power of the first supply power unit.

At this point, in the lighting control apparatus using a wire and wireless integrated dimming circuit according to an embodiment of the present invention, the power distribution module includes: a first wired resistor connected to a wired dimming signal input unit in series; a second wired resistor connected to the wired dimming signal input unit in parallel; a third wired resistor connected to the first wired resistor in series; and a fourth wired resistor connected to the third wired resistor in parallel.

At this point, in the lighting control apparatus using a wire and wireless integrated dimming circuit according to an embodiment of the present invention, the wired module further includes: an input filter module for removing noise of a wired dimming signal input; and an output filter module for removing noise of a wired dimming signal output.

In addition, in the lighting control apparatus using a wire and wireless integrated dimming circuit according to an embodiment of the present invention, the wired module further includes a first diode for preventing reverse bias voltage.

In addition, in the lighting control apparatus using a wire and wireless integrated dimming circuit according to an embodiment of the present invention, the wireless module receives a PWM dimming signal.

In addition, in the lighting control apparatus using a wire and wireless integrated dimming circuit according to an embodiment of the present invention, the wireless module includes: a second supply power unit; a wireless signal input unit for inputting a wireless dimming signal; a first switch element applied with the wireless dimming signal to perform an on/off operation; and a second switch element for performing an operation opposite to the operation of the first switch element and generating a dimming signal by the on/off operation.

At this point, in the lighting control apparatus using a wire and wireless integrated dimming circuit according to an embodiment of the present invention, the wireless module includes: a first wireless resistor connected to the wireless signal input unit in series; a first wireless capacitor and a second wireless resistor connected to the first wireless resistor in parallel; a third wireless resistor and a second wireless capacitor connected to an output terminal of the first switch element in parallel; a fourth wireless resistor connected between the output terminal of the first switch element and the supply power unit; and a fifth wireless resistor connected between an output terminal of the second switch element and the supply power unit.

At this point, in the lighting control apparatus using a wire and wireless integrated dimming circuit according to an embodiment of the present invention, the wireless module includes: a sixth wireless resistor connected to an output terminal of the second switch element in series; a seventh wireless resistor connected to the sixth wireless resistor in series; a third wireless capacitor connected to the seventh wireless resistor in parallel; an eighth wireless resistor connected between the sixth wireless resistor and the seventh wireless resistor in parallel; and a ninth wireless resistor connected to the eighth wireless resistor in series.

In addition, in the lighting control apparatus using a wire and wireless integrated dimming circuit according to an embodiment of the present invention, the wireless module further includes a second diode for preventing reverse bias voltage.

In addition, in the lighting control apparatus using a wire and wireless integrated dimming circuit according to an embodiment of the present invention, the transform module receives the wired dimming signal or the wireless dimming signal and transforms primary side power to secondary side power.

In addition, the lighting control apparatus using a wire and wireless integrated dimming circuit according to an embodiment of the present invention further comprises a standby module for generating a voltage for driving the converter.

To accomplish the above objects, according to another aspect of the present invention, there is provided a lighting control apparatus using a wire and wireless integrated dimming circuit, the apparatus comprising: an input power supply unit; a converter for converting input power to lighting unit supply power; a lighting unit applied with the lighting unit supply power to emit light; a wireless module for inputting a wireless dimming signal for controlling the lighting unit; a wired module for inputting a wired dimming signal for controlling the lighting unit; and a transform module for receiving the wireless dimming signal or the wired dimming signal, transforming the received dimming signal to a preset power, and applying the transformed power to the converter, wherein the wireless module and the wired module commonly include a voltage apply module, selectively receive the wireless dimming signal or the wired dimming signal, and apply the received dimming signal to the transform module.

In addition, the lighting control apparatus using a wire and wireless integrated dimming circuit according to another embodiment of the present invention further comprises an EMI filter for removing noise of the input power and applying the input power to the converter.

In addition, in the lighting control apparatus using a wire and wireless integrated dimming circuit according to another embodiment of the present invention, the converter includes: a PFC converter; and a fly-back converter.

In addition, in the lighting control apparatus using a wire and wireless integrated dimming circuit according to another embodiment of the present invention, the converter receives the wired dimming signal or the wireless dimming signal and controls dimming of the lighting unit if a necessary driving condition is satisfied.

In addition, in the lighting control apparatus using a wire and wireless integrated dimming circuit according to another embodiment of the present invention, the wireless module receives a PWM dimming signal.

In addition, in the lighting control apparatus using a wire and wireless integrated dimming circuit according to another embodiment of the present invention, the wireless module includes: a supply power unit; a wireless signal input unit for inputting a PWM dimming signal; a first switch element applied with the PWM dimming signal to perform an on/off operation; a second switch element for performing an operation opposite to the operation of the first switch element; and a voltage apply module for converting a square-wave dimming signal generated by the second switch element to an analog power.

At this point, in the lighting control apparatus using a wire and wireless integrated dimming circuit according to another embodiment of the present invention, the wireless module includes: a first resistor connected to the wireless signal input unit in series; a first capacitor and a zener diode connected to the first resistor in parallel; a second resistor and a second capacitor connected to an output terminal of the first switch element in parallel; a third resistor connected between the output terminal of the first switch element and the supply power unit; and a fourth resistor connected between an output terminal of the second switch element and the supply power unit.

In addition, in the lighting control apparatus using a wire and wireless integrated dimming circuit according to another embodiment of the present invention, the voltage apply module includes: a fifth resistor connected to an output terminal of the second switch element in series; a sixth resistor connected to the fifth resistor in parallel; and a third capacitor and a fourth capacitor connected to the fifth resistor in parallel.

In addition, in the lighting control apparatus using a wire and wireless integrated dimming circuit according to another embodiment of the present invention, the wired module includes a wired signal input unit for receiving a 0 to 10V dimming signal and applying the received dimming signal to the voltage apply module.

At this point, in the lighting control apparatus using a wire and wireless integrated dimming circuit according to another embodiment of the present invention, the wired module further include: a line filter for removing noise of the 0 to 10V dimming signal; and a diode for preventing reverse bias voltage of the voltage apply module.

In addition, in the lighting control apparatus using a wire and wireless integrated dimming circuit according to another embodiment of the present invention, the transform module receives the wireless dimming signal or the wired dimming signal and transforms primary side power to secondary side power.

In addition, the lighting control apparatus using a wire and wireless integrated dimming circuit according to another embodiment of the present invention further comprises a standby module for generating a voltage for driving the converter.

DETAILED DESCRIPTION OF THE PREFERRED EMBODIMENT

Figure 1:
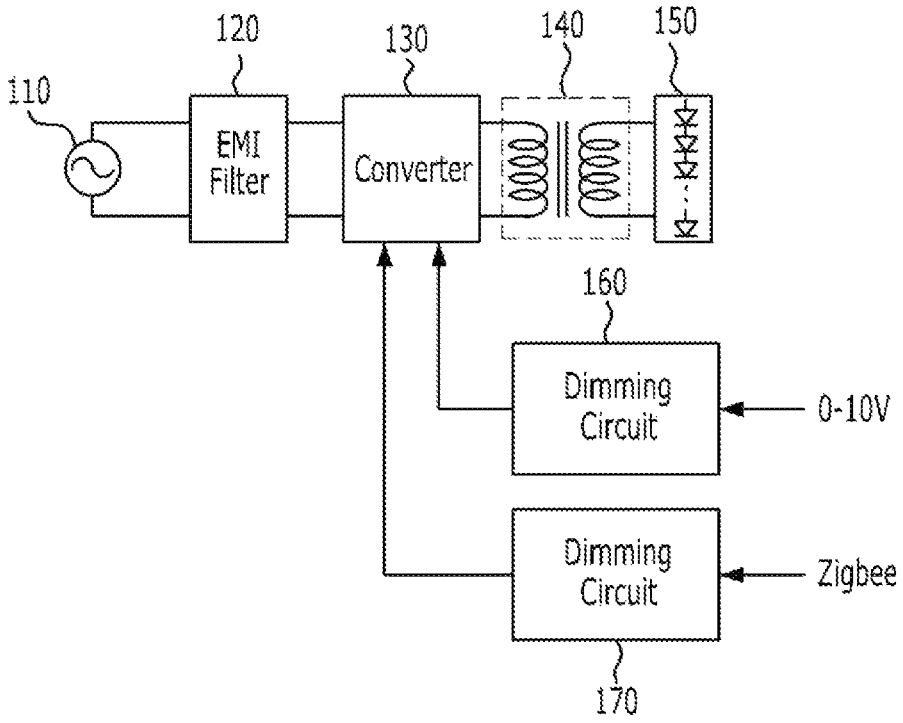
FIG.1 RELATED ART
FIG. 1 is a view showing the configuration of a lighting control apparatus of a conventional invention.

Hereinafter, a 'lighting control apparatus using a wire and wireless integrated dimming circuit' according to the present invention will be described in detail with reference to the accompanying drawings. The disclosed embodiments are provided to enable those skilled in the art to easily understand the scope of the present invention, and the present invention is not limited by such embodiments. Moreover, matters illustrated in the drawings are schematized in order to describe or explain the embodiments of the present invention more easily and hence may be different from actually embodied forms.

Meanwhile, the constitutional components expressed below are merely examples for implementing the present invention. Accordingly, other constitutional components may be used in other implementations of the present invention without departing from the spirit and scope of the present invention.

In addition, the expression of 'including' a component is an expression of an 'open type' which merely refers to existence of a corresponding component, and it should not be construed as precluding additional components.

In addition, the expressions such as 'first', 'second' and the like are expressions used only to distinguish a plurality of constitutions and do not limit the sequence or other features of the constitutions.

In describing the embodiments, a description of forming a layer (film), region, pattern or structure "on" or "under" another substrate, layer (film), region, pad or pattern includes directly forming or interposing another layer. The reference of "on" or "under" of each layer is defined with respect to the drawings.

When an element is connected to another element, it includes a case of indirectly connecting the elements interposing another member therebetween, as well as a case of directly connecting the elements. In addition, when an element includes a component, it means further including another component, not excluding another component, as far as an opposed description is not specially specified.

FIG. 1 is a view showing the configuration of a lighting control apparatus of a conventional invention.

Referring to FIG. 1, in order to implement a lighting apparatus using both a wired dimming circuit 160 and a wireless dimming circuit 170, boards including each of the circuits should be separately manufactured. In addition, since the conventionally used wired dimming circuit 160 adopts a complicated circuit using an OP-AMP, there is a problem in that high price and high volume are enforced due to the configuration of the circuit.

Accordingly, in order to solve the disadvantage of inducing increase of the price and decreasing universality, lighting apparatuses using a wire and wireless integrated dimming circuit are studied diversely to configure a circuit avoiding enlargement and overpopulation of components and support mass-productivity through simple implementation of the circuit.

In order to solve the problem of the conventional lighting control apparatus, the present invention may implement a wire and wireless integrated dimming circuit, which integrates wired dimming (0 to 10V dimming, 1 to 10V dimming or the like) and wireless dimming (Zigbee dimming, BLE dimming, Bluetooth dimming or the like) in one circuit to implement miniaturization and integration of components and selectively receives a wired dimming signal or a wireless dimming signal. Details thereof will be described with reference to FIGS. 2 to 5.

Figure 2:
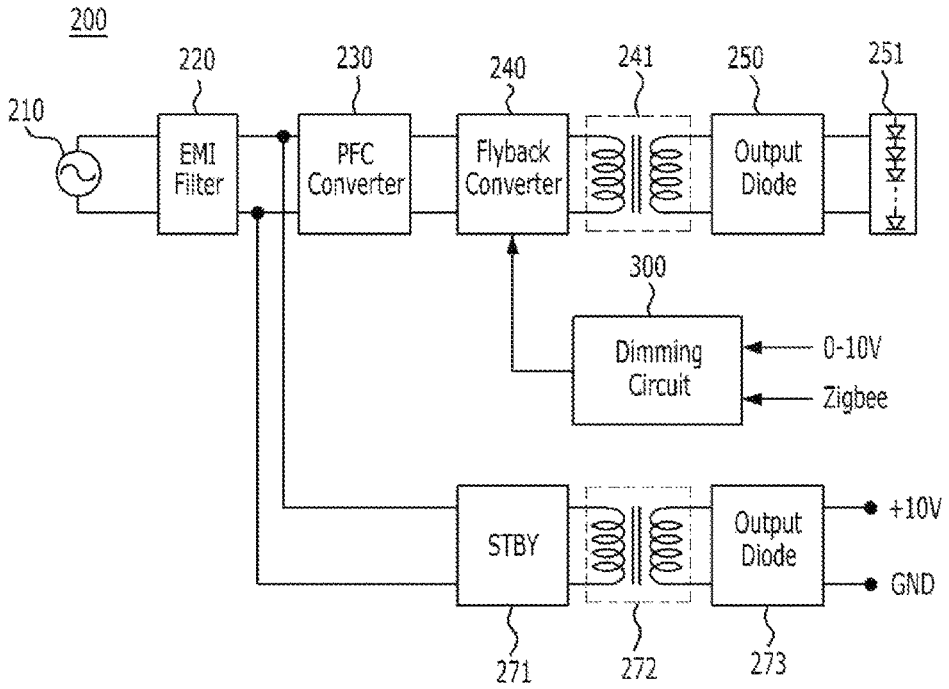
FIG. 2 is a view showing the configuration of a lighting control apparatus according to an embodiment of the present invention.
Figure 3:
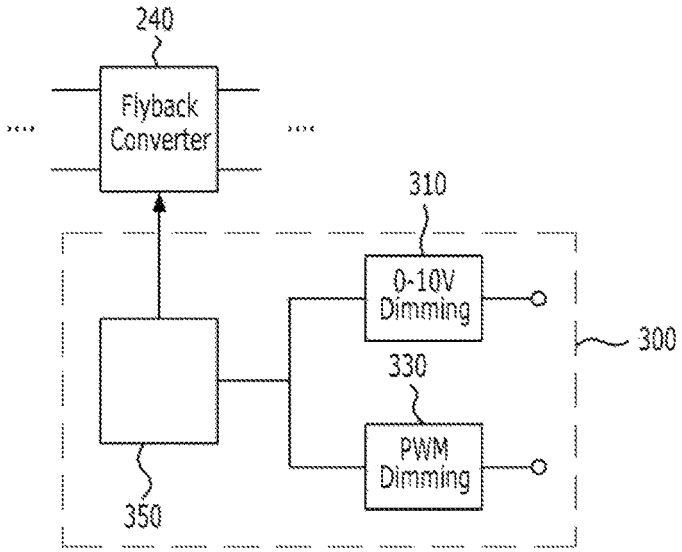
FIG. 3 is a view showing the configuration of a wire and wireless integrated dimming circuit of a lighting control apparatus according to an embodiment of the present invention.

FIG. 2 is a view showing the configuration of a lighting control apparatus according to an embodiment of the present invention, and FIG. 3 is a view showing the configuration of a wire and wireless integrated dimming circuit of a lighting control apparatus according to an embodiment of the present invention.

Referring to FIGS. 2 and 3, a lighting control apparatus according to an embodiment of the present invention may include an input power supply unit 210, a converter 230 and 240, a lighting unit 251, a wired module 310, a wireless module 330 and a transform module 350.

The input power supply unit 210 supplies overall input power of the lighting apparatus. At this point, the input power input into the input power supply unit 210 is preferably 220V commercial power, and the 220V commercial power may have a sine wave form periodically alternating between −311V and +311V. More specifically, the input power supply unit may perform a function of supplying power to various elements used in the lighting apparatus.

In addition, an EMI filter 220 may be further included in the input power supply unit to remove noise of the input power and apply input power free from noise to the converter. If the input power is supplied from the input power supply unit, electrical noise is converted to a magnetic field, and electromagnetic interference (EMI) generating interference to other components of the lighting control apparatus may be generated, and such a noise can be removed using the EMI filter.

The converter 230 and 240 converts the input power into lighting unit supply power. The converter performs a power control function of receiving main power and converting the main power to supply stable and efficient power requested from the system. Particularly, the converter of the present invention may be implemented as an AC/DC converter for converting AC power to DC power and may perform AC/DC conversion using various rectifying circuits, such as a diode rectifier, a phase control rectifier, a bridge rectifier and the like, a plurality of switches and a transformer to accomplish desired power conversion while minimizing power loss.

In addition, the converter of the present invention may include a PFC converter 230 and a fly-back converter 240. Particularly, the fly-back converter is a circuit system of an insulation type switched-mode power supply (SMPS), which is electrically insulated from a line supplying power and thus may stably supply power to the output terminal.

In addition, the converter of the present invention may receive the wireless dimming signal or the wired dimming signal and control dimming of the lighting unit if a necessary driving condition is satisfied. More specifically, the fly-back converter is the main block of a driving power supply of an LED lighting unit and may control dimming of the driving power supply of the LED lighting unit when Vcc voltage and the necessary driving condition are satisfied.

In addition, although a general DC power may be used to generate a voltage for driving the converter of the present invention, a standby module 271 for generating the voltage for driving the converter may be separately implemented.

The lighting unit 251 is applied with the lighting unit supply power and emits light. The converter converts the input power into the lighting unit supply power and applies the converted power to the lighting unit. Particularly, the lighting unit 251 of the present invention may be configured of a light emitting diode (LED). The LED is a light source based on semiconductor, which is a light source generally and widely used as it has various advantages such as low price, long lifespan, small size, eco-friendly waste disposal, low energy consumption, high efficiency, linearity and the like.

The dimmer inputs a dimming signal for controlling the lighting unit. Such a dimmer is a device for changing intensity, illuminance or color of a lamp by continuously increasing or decreasing them, and both wired handling and wireless handling (remote handling) are allowed.

Particularly, the dimmer of the present invention inputs at least any one dimming signal among a 0 to 10V dimming signal, a 1 to 10V dimming signal and a PWM dimming signal. The 0 to 10V dimming signal controls the lighting unit by varying voltage of a control line from 0V to 10V, and the 1 to 10V dimming signal controls by varying the voltage from 1V to 10V. In addition, the PWM dimming signal adjusts current amount by modulating the width of a frequency which control the power. The dimmer of the present invention may be used by inputting various generally used dimming signals, in addition to the dimming signals described above.

More specifically, the dimmer of the present invention may include the wired module 310 for inputting a wired dimming signal and the wireless module 330 for inputting a wireless dimming signal. In addition, since the wired module and the wireless module are connected in parallel, the dimmer of the present invention may selectively receive a wired dimming signal or a wireless dimming signal. Accordingly, a user or a manager may control dimming of the lighting apparatus by selecting wireless dimming or wired dimming as needed.

More specifically, the wireless module does not operate if a 0 to 10V dimming signal is input by the wired module, and the wired module does not operate if a PWM dimming signal is input by the wireless module. This is since that the wired module and the wireless module are connected in parallel.

Accordingly, an error that may occur by simultaneously inputting the wired dimming signal and the wireless dimming signal can be prevented.

The transform module 350 receives the wireless dimming signal or the wired dimming signal, transforms the received dimming signal to a preset power, and applies the transformed power to the converter. More specifically, the transform module may receive the wireless dimming signal or the wired dimming signal and transform the primary side power to the secondary side power. If a dimming signal is received and transformed to an analog voltage (about 0 to 2.5V or 2.5 to 5V), the dimming signal should be transformed to a power of an appropriate value since power of this value cannot be applied to the power control apparatus as is. Accordingly, the primary side power may be transformed to the secondary side power through the transform module and used for the converter and the power control apparatus.

Figure 4:
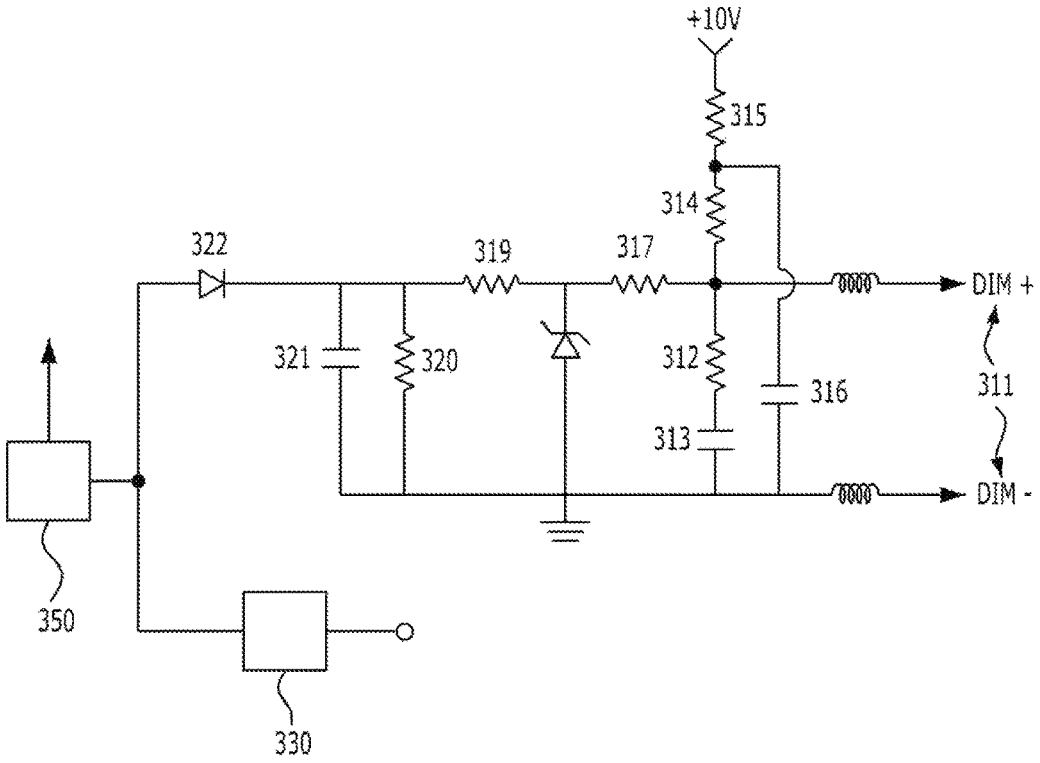
FIG. 4 is a circuit diagram showing a wired module of a wire and wireless integrated dimming circuit of a lighting control apparatus according to an embodiment of the present invention.

FIG. 4 is a circuit diagram showing a wired module of a wire and wireless integrated dimming circuit of a lighting control apparatus according to an embodiment of the present invention.

Referring to FIG. 4, the configuration of a wired module for selectively receiving a wired dimming signal can be confirmed. The wired module 310 of the present invention may include a wired signal input unit 311, a first supply power unit (+10V), a power distribution module 312, 317, 319 and 320, an input filter module 313 and 316, an output filter module 321 and a first diode 322.

The wired module 310 inputs a wired dimming signal for controlling the lighting unit. At this point, the wired module may receive a wired dimming signal through the wired signal input unit 311 and apply the wired dimming signal. In addition, the wired signal input unit may receive a 0 to 10V dimming signal and input an analog voltage between 0 and 10V.

The power distribution module 312, 317, 319 and 320 distributes power of the first supply power unit (+10V). At this point, the power distribution module is preferably configured of a plurality of resistors. Magnitude of the power applied to the node may be adjusted by adjusting magnitude of a first wired resistor 317, a second wired resistor 312, a third wired resistor 319 and a fourth wired resistor 320, and a value of the output dimming signal of the wired module may be adjusted according to a difference between the magnitude of the dimming signal applied to the node and the wired signal input unit.

The first wired resistor 317 is connected to the wired signal input unit in series, and the second wired resistor 312 is connected to the wired signal input unit in parallel. In addition, the third wired resistor 319 is connected to the first wired resistor in series, and the fourth wired resistor 320 is connected to the third wired resistor in parallel. At this point, positions of the first wired resistor, the second wired resistor, the third wired resistor and the fourth wired resistor may be changes to an appropriate arrangement according to the magnitude of power distribution.

In addition, the wired module of the present invention may further include the input filter module and the output filter module for removing noise from input and output power. The input filter module 313 and 316 may remove noise of wired dimming signal input, and the output filter module 321 may remove noise of wired dimming signal output. Particularly, the input filter module and the output filter module may be implemented as an RC noise filter of a plurality of capacitors or resistor-capacitors or may be implemented as a general noise filter module.

The first diode 322 prevents reverse bias voltage of a voltage apply module. Since a reverse bias is generated and the circuit itself may be broken down if voltage is concentrated at the output, this can be prevented by including the diode in the wired signal input unit. In addition, the first diode may prevent short circuit of the wired module.

Figure 5:
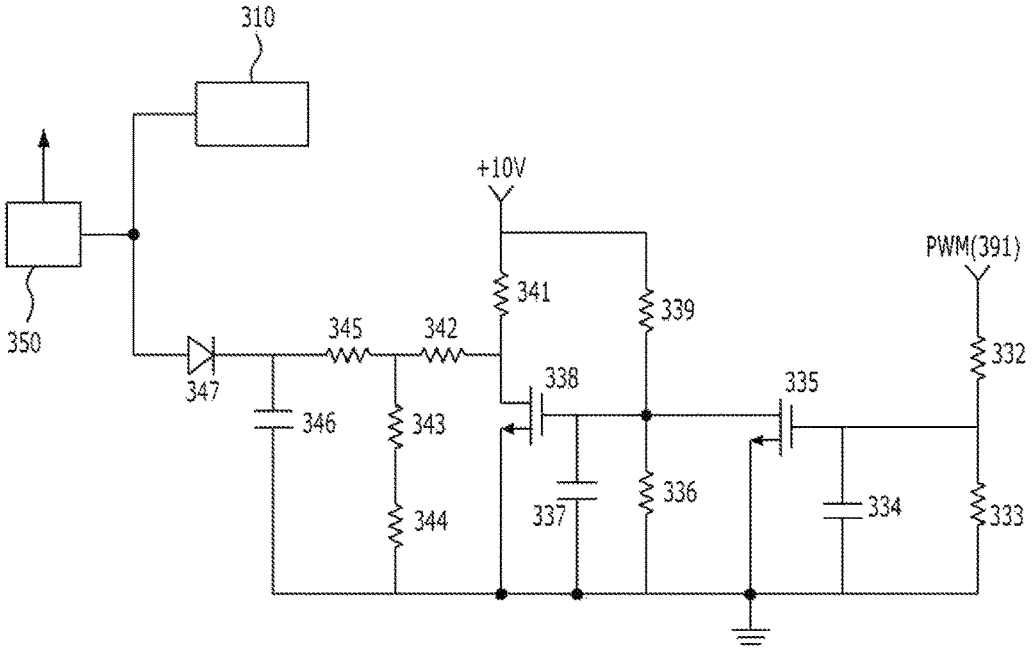
FIG. 5 is a circuit diagram showing a wireless module of a wire and wireless integrated dimming circuit of a lighting control apparatus according to an embodiment of the present invention.
Figure 6:
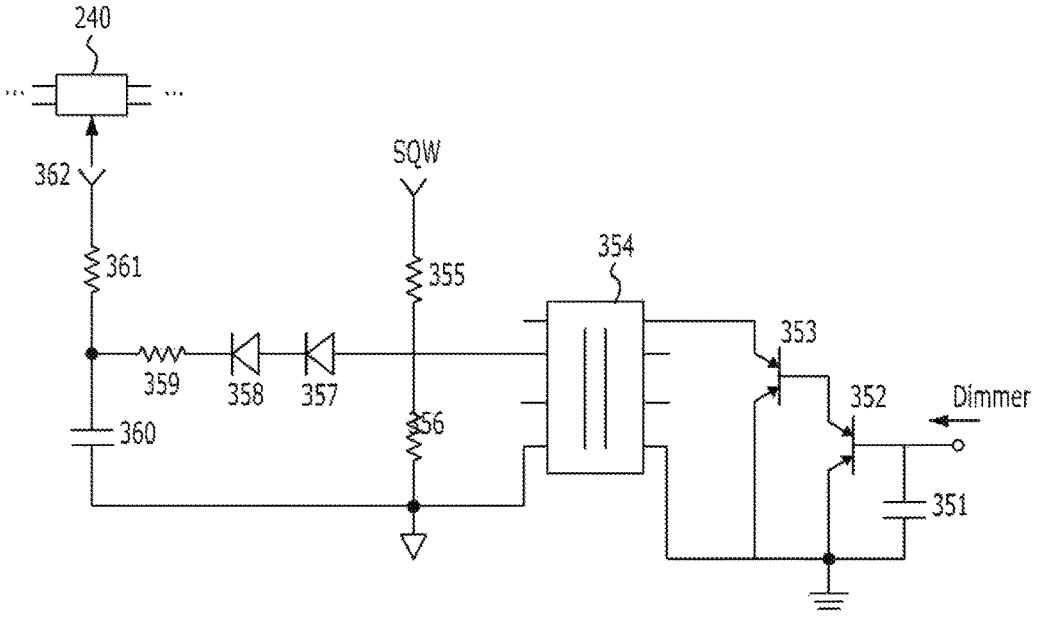
FIG. 6 is a circuit diagram showing a transform module of a wire and wireless integrated dimming circuit of a lighting control apparatus according to an embodiment of the present invention.

FIG. 5 is a circuit diagram showing a wireless module of a wire and wireless integrated dimming circuit of a lighting control apparatus according to an embodiment of the present invention.

Referring to FIG. 5, the configuration of a wireless module for selectively receiving a wireless dimming signal can be confirmed.

The wireless module 330 inputs a wireless dimming signal for controlling the lighting unit. The wireless module of the present invention may include a second supply power unit (+10V), a wireless signal input unit 331, a first switch element Q1 335 and a second switch element Q2 338. In addition, the wireless module may further include a first wireless resistor 332, a first wireless capacitor 334, a second wireless resistor 333, a second wireless capacitor 337, a third wireless resistor 336, a fourth wireless resistor 339 and a fifth wireless resistor 341. At this point, the wireless module 330 preferably receives a PWM dimming signal.

The second supply power unit inputs 10V supply power. Such a supply power may act as a driving power of the first switch element and the second switch element and may be applied to a voltage apply module to generate an analog voltage of a magnitude corresponding to the cycle (duty) of the PWM dimming signal. More specifically, magnitude of the analog voltage increases as the cycle of the PWM dimming signal increases, and magnitude of the analog voltage decreases as the cycle of the PWM dimming signal decreases.

The wireless signal input unit 331 receives the PWM dimming signal. If the PWM dimming signal is input with a cycle of high-low-high-low or the like, the signal can be transformed by the first switch element and the second switch element.

The first switch element Q1 335 is applied with the PWM dimming signal and performs an on/off operation, and the second switch element Q2 338 performs an operation opposite to the operation of the first switch element. At this point, the first switch element and the second switch element may be configured of at least any one of FET, BJT and SCR. In addition, a square-wave dimming signal generated by the second switch element is converted to an analog power.

More specifically, if the PWM dimming signal is high H, a 3V signal is applied, and the first switch element Q1 335 is connected. If the first switch element is turned on, the gate voltage of the second switch element becomes zero, and the drain and source of the second switch element are in an open state. Accordingly, the 10V supply power of the supply power unit is applied to the voltage apply module as is, and the voltage apply module becomes 10V.

In addition, if the PWM dimming signal is low L, a 0V signal is applied, and the first switch element Q1 335 is not connected. If the first switch element is turned off, the gate voltage of the second switch element is applied, and the drain and source of the second switch element are in a short state. Accordingly, since the 10V supply power of the supply power unit is drained through the line of the short state, magnitude of the power applied to the voltage apply module becomes 0V.

The first wireless resistor R1 332 is connected to the wireless signal input unit in series to perform a current control function according to the PWM dimming signal. The first wireless capacitor 334 and the second wireless resistor 333 are connected to the first wireless resistor in parallel to perform a function of an RC filter which removes noise of the input PWM dimming signal. The third wireless resistor 336 is connected to the output terminal of the first switch element in parallel to control magnitude of the voltage applied to the second switch element. The second wireless capacitor 337 is connected to the output terminal of the first switch element in parallel to remove noise of a signal generated by the first switch element.

The fourth wireless resistor 339 is connected between the output terminal of the first switch element and the supply power unit to apply the supply power (+10V) to the first switch element. The fifth wireless resistor 341 is connected between the output terminal of the second switch element and the supply power unit to perform a function of dividing the supply power of the supply power unit according to setting of magnitude of a resistor existing at the output terminal of the second switch element.

The sixth wireless resistor 342, the seventh wireless resistor 345, the eighth wireless resistor 343 and the ninth wireless resistor 344 distribute power of the second supply power unit (+10V). Magnitude of the power applied to the node may be adjusted by adjusting magnitude of the sixth wireless resistor 342, the seventh wireless resistor 345, the eighth wireless resistor 343 and the ninth wireless resistor 344, and a value of the output dimming signal of the wireless module may be adjusted according to a difference between the magnitude of the dimming signal applied to the node and the wireless signal input unit.

In addition, the sixth wireless resistor 342 is connected to the output terminal of the second switch element 338 in series, and the seventh wireless resistor 345 is connected to the sixth wireless resistor in series. The eighth wireless resistor 343 is connected between the sixth wireless resistor and the seventh wireless resistor in parallel, and the ninth wireless resistor 344 is connected to the eighth wireless resistor in series. At this point, positions of the wireless resistors may be changes to an appropriate arrangement according to the magnitude of power distribution.

A third wireless capacitor 346 is connected to the seventh wireless resistor in parallel to implement a circuit for removing noise and smoothing the output signal. Since the generated signal passing through the first and second switch elements may contain ripple voltage in the DC current compared with the input PWM dimming signal, a smoothing circuit should be implemented to reduce the ripples.

The second diode 347 prevents reverse bias voltage of a voltage apply module, like the first diode. Since a reverse bias is generated and the circuit itself may be broken down if voltage is concentrated at the output, this can be prevented by including the diode in the wireless signal input unit. In addition, the second diode may prevent short circuit of the wireless module.

Figure 7:
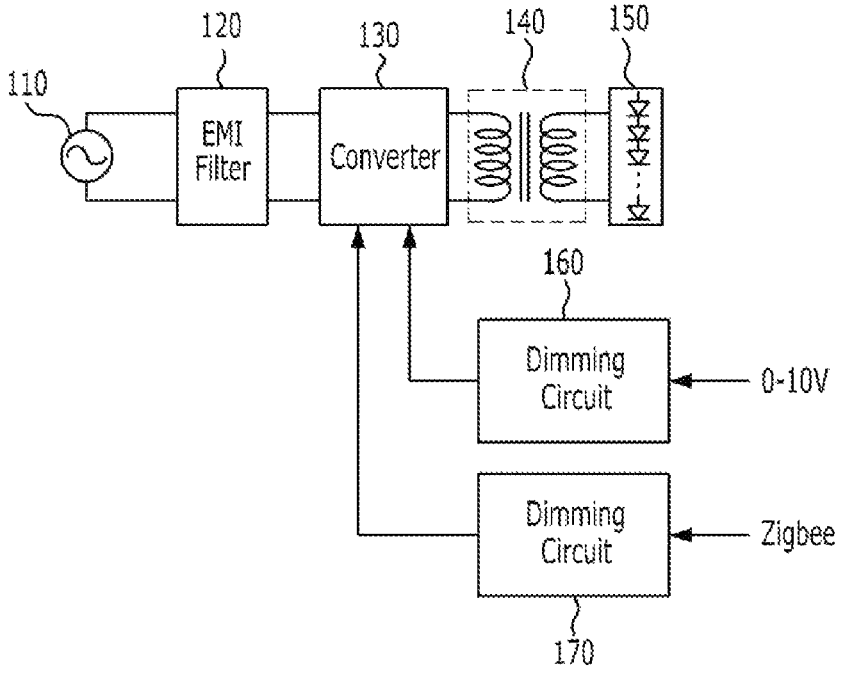
FIG. 7 is a view showing the configuration of a lighting control apparatus of a conventional invention.

FIG. 7 is a view showing the configuration of a lighting control apparatus of a conventional invention.

Referring to FIG. 7, in order to implement a lighting apparatus using both a wired dimming circuit 460 and a wireless dimming circuit 470, boards including each of the circuits should be separately manufactured. In addition, since the conventionally used wired dimming circuit 460 adopts a complicated circuit using an OP-AMP, there is a problem in that high price and high volume are enforced due to the configuration of the circuit.

Accordingly, in order to solve the disadvantage of inducing increase of unit price and decreasing universality, lighting apparatuses using a wire and wireless integrated dimming circuit are studied diversely to configure a circuit avoiding enlargement and overpopulation of components and support mass-productivity through simple implementation of the circuit.

In order to solve the problem of the conventional lighting control apparatus, the present invention may implement a wire and wireless integrated dimming circuit, which integrates wired dimming (0 to 10V dimming, 1 to 10V dimming or the like) and wireless dimming (Zigbee dimming, BLE dimming, Bluetooth dimming or the like) in one circuit to implement miniaturization and integration of components and selectively receives a wired dimming signal or a wireless dimming signal. Details thereof will be described with reference to FIGS. 8 to 11.

Figure 8:
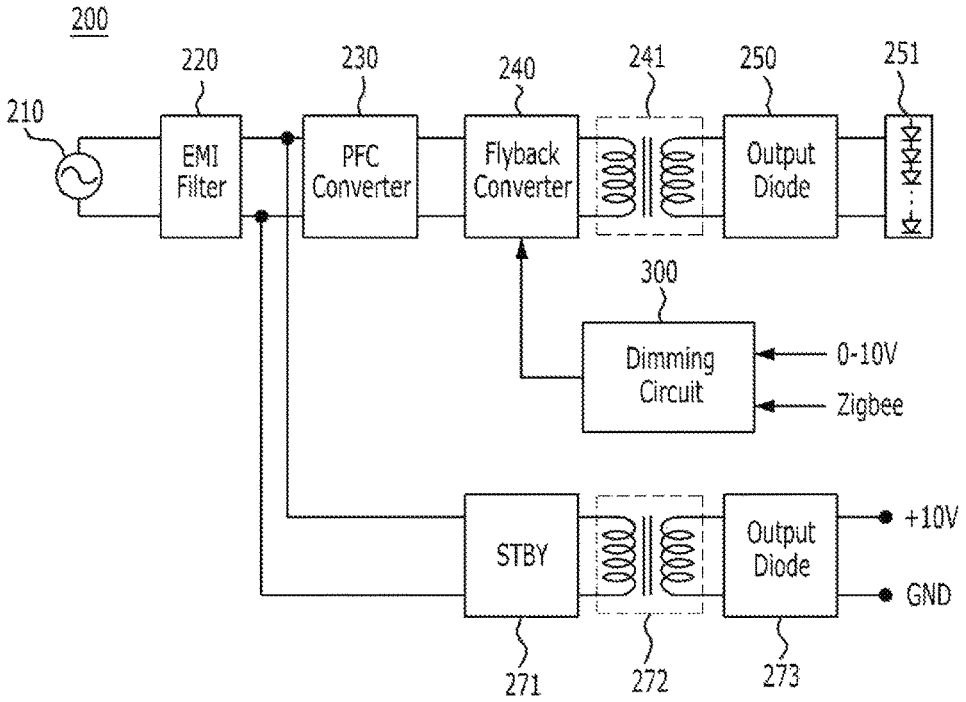
FIG. 8 is a view showing the configuration of a lighting control apparatus according to another embodiment of the present invention.
Figure 9:
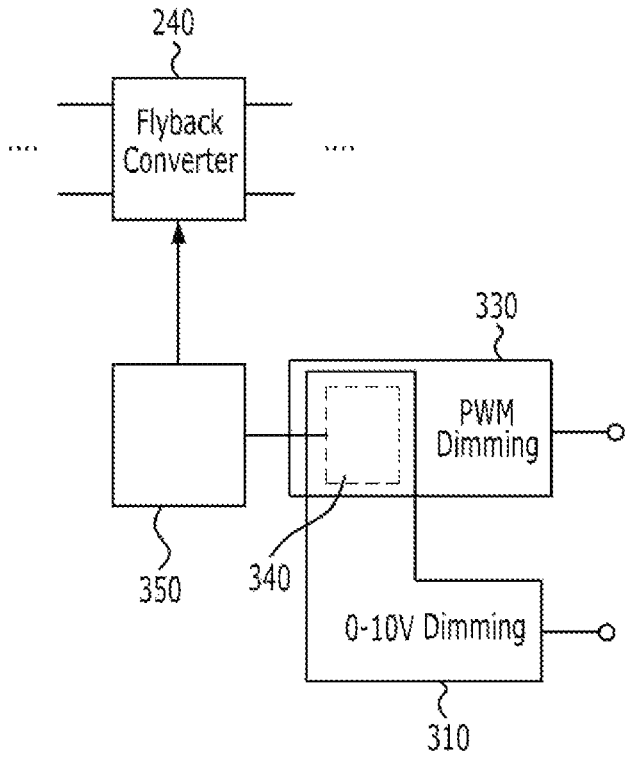
FIG. 9 is a view showing the configuration of a wire and wireless integrated dimming circuit of a lighting control apparatus according to another embodiment of the present invention.

FIG. 8 is a view showing the configuration of a lighting control apparatus according to another embodiment of the present invention, and FIG. 9 is a view showing the configuration of a wire and wireless integrated dimming circuit of a lighting control apparatus according to another embodiment of the present invention.

Referring to FIGS. 8 and 9, a lighting control apparatus according to an embodiment of the present invention may include an input power supply unit 510, a converter 530 and 540, a lighting unit 551, a wireless module 630, a wired module 610 and a transform module 650.

The input power supply unit 510 supplies overall input power of the lighting apparatus. At this point, the input power input into the input power supply unit 510 is preferably 520V commercial power, and the 520V commercial power may have a sine wave form periodically alternating between −611V and +611V. More specifically, the input power supply unit may perform a function of supplying power to various elements used in the lighting apparatus.

In addition, an EMI filter 520 may be further included in the input power supply unit to remove noise of the input power and apply input power free from noise to the converter. If the input power is supplied from the input power supply unit, electrical noise is converted to a magnetic field, and electromagnetic interference (EMI) generating interference to other components of the lighting control apparatus may be generated, and such a noise can be removed using the EMI filter.

The converter 530 and 540 converts the input power into lighting unit supply power. The converter performs a power control function of receiving main power and converting the main power to supply stable and efficient power requested from the system. Particularly, the converter of the present invention may be implemented as an AC/DC converter for converting AC power to DC power and may perform AC/DC conversion using various rectifying circuits, such as a diode rectifier, a phase control rectifier, a bridge rectifier and the like, a plurality of switches and a transformer for the purpose of desired power conversion while minimizing power loss.

In addition, the converter of the present invention may include a PFC converter 530 and a fly-back converter 540. Particularly, the fly-back converter is a circuit system of an insulation type switched-mode power supply (SMPS), which is electrically insulated from a line supplying power and thus may stably supply power to the output terminal.

In addition, the converter of the present invention may receive the wireless dimming signal or the wired dimming signal and control dimming of the lighting unit if a necessary driving condition is satisfied. More specifically, the fly-back converter is the main block of a driving power supply of an LED lighting unit and may control dimming of the driving power supply of the LED lighting unit when Vcc voltage and the necessary driving condition are satisfied.

In addition, although a general DC power may be used to generate a voltage for driving the converter of the present invention, a standby module 571 for generating the voltage for driving the converter may be separately implemented.

The lighting unit 551 is applied with the lighting unit supply power and emits light. The converter converts the input power into the lighting unit supply power and applies the converted power to the lighting unit. Particularly, the lighting unit 551 of the present invention may be configured of a light emitting diode (LED). The LED is a light source based on semiconductor, which is a light source generally and widely used as it has various advantages such as low price, long lifespan, small size, eco-friendly waste disposal, low energy consumption, high efficiency, linearity and the like.

The dimmer inputs a dimming signal for controlling the lighting unit. Such a dimmer is a device for changing intensity, illuminance or color of a lamp by continuously increasing or decreasing them, and both wired handling and wireless handling (remote handling) are allowed.

Particularly, the dimmer of the present invention inputs at least any one dimming signal among a 0 to 10V dimming signal, a 1 to 10V dimming signal and a PWM dimming signal. The 0 to 10V dimming signal controls the lighting unit by varying voltage of a control line from 0V to 10V, and the 1 to 10V dimming signal controls by varying the voltage from 1V to 10V. In addition, the PWM dimming signal adjusts current amount by modulating the width of a frequency which control the power. The dimmer of the present invention may be used by inputting various generally used dimming signals, in addition to the dimming signals described above.

More specifically, the dimmer of the present invention may include the wireless module 630 for inputting a wireless dimming signal and the wired module 610 for inputting a wired dimming signal. In addition, the dimmer of the present invention may selectively receive the wired dimming signal or the wireless dimming signal. Particularly, since the present invention has been implemented to commonly include the voltage apply module, an error may occur in the lighting control apparatus if the wired dimming signal and the wireless dimming signal are simultaneously received, and thus only any one of the wired dimming signal and the wireless dimming signal is selectively received. Accordingly, a user or a manager may control dimming of the lighting apparatus by selecting wireless dimming or wired dimming as needed.

The transform module 650 receives the wireless dimming signal and the wired dimming signal, transforms the received dimming signal to a preset power, and applies the transformed power to the converter. More specifically, the transform module may receive the wireless dimming signal or the wired dimming signal and transform the primary side power to the secondary side power. If a dimming signal is received and transformed to an analog voltage (about 2.5 to 5V) by the voltage apply module, the dimming signal should be transformed to a power of an appropriate value since power of this value cannot be applied to the power control apparatus as is. Accordingly, the primary side power may be transformed to the secondary side power through the transform module and used for the converter and the power control apparatus.

Figure 10:
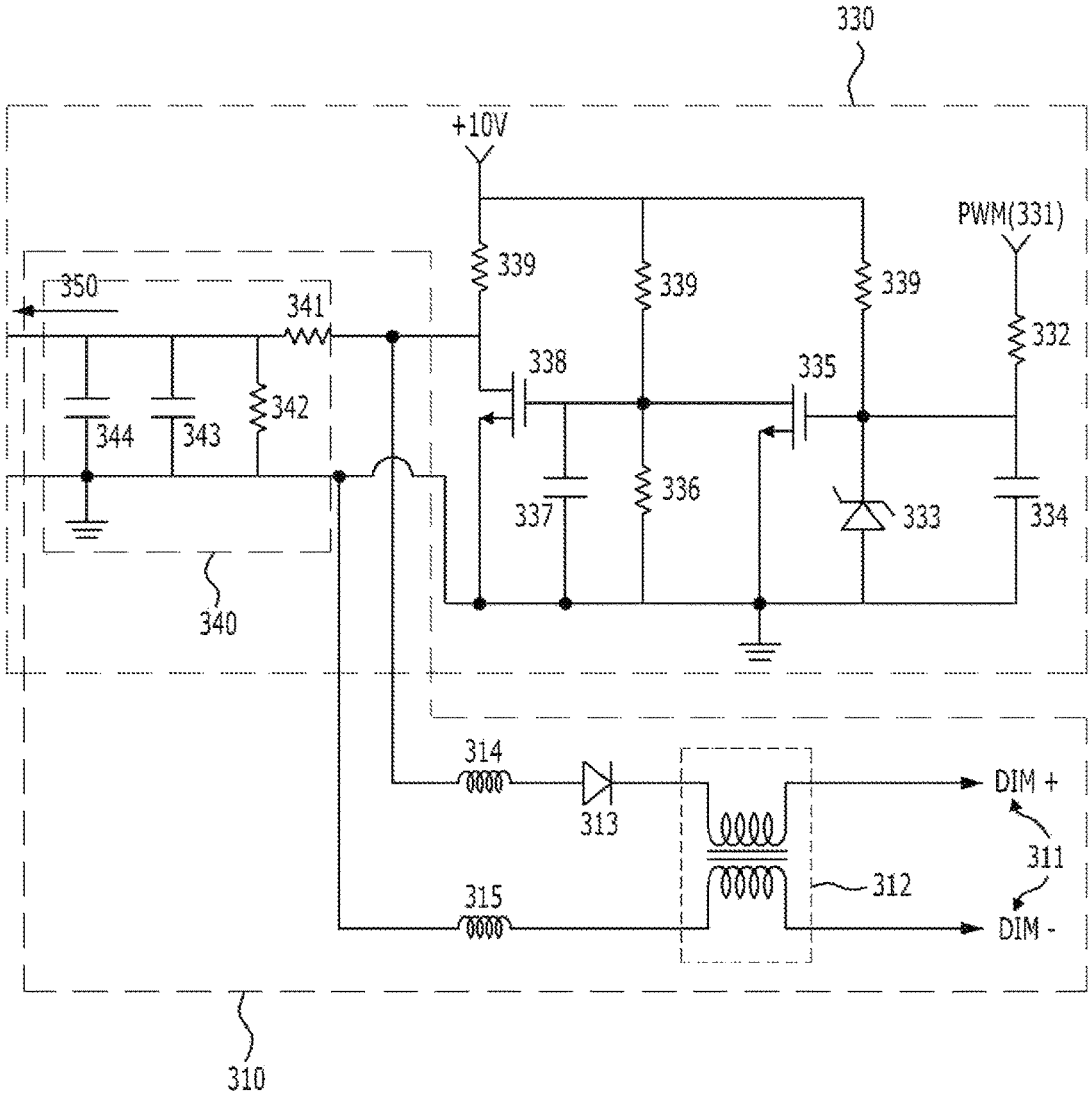
FIG. 10 is a circuit diagram showing a wire and wireless integrated dimming circuit of a lighting control apparatus according to another embodiment of the present invention.
Figure 11:
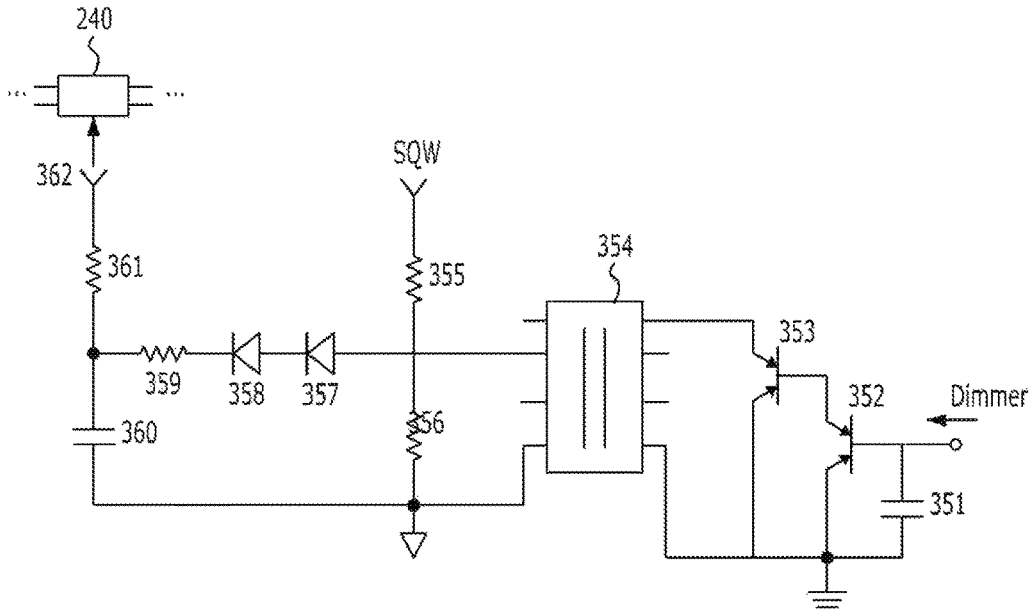
FIG. 11 is a circuit diagram showing a transform module of a wire and wireless integrated dimming circuit of a lighting control apparatus according to another embodiment of the present invention.

FIG. 10 is a circuit diagram showing a wire and wireless integrated dimming circuit of a lighting control apparatus according to another embodiment of the present invention.

Referring to FIG. 10, the configuration of a wireless module, a wired module and a voltage apply module for selectively receiving a wired dimming signal or a wireless dimming signal can be confirmed. Particularly, the wireless module 630 and the wired module 610 may commonly include the voltage apply module 640. The voltage apply module operates when the wireless dimming signal or the wired dimming signal is received and may apply the generated power to the transform module.

The wireless module 630 inputs a wireless dimming signal for controlling the lighting unit. The wireless module of the present invention may include a supply power unit (+10V), a wireless signal input unit 631, a first switch element Q1 635, a second switch element Q2 638 and a voltage apply module 640. In addition, the wireless module may further include a first resistor 632, a first capacitor 634, a zener diode 633, a second resistor 636, a second capacitor 637, a third resistor 639 and a fourth resistor. At this point, the wireless module 630 preferably receives a PWM dimming signal.

The supply power unit inputs 10V supply power. Such a supply power may act as a driving power of the first switch element and the second switch element and may be applied to a voltage apply module to generate an analog voltage of a magnitude corresponding to the cycle (duty) of the PWM dimming signal. More specifically, magnitude of the analog voltage increases as the cycle of the PWM dimming signal increases, and magnitude of the analog voltage decreases as the cycle of the PWM dimming signal decreases.

The wireless signal input unit 631 receives the PWM dimming signal. If the PWM dimming signal is input with a cycle of high-low-high-low or the like, the signal can be transformed by the first switch element and the second switch element.

The first switch element Q1 635 is applied with the PWM dimming signal and performs an on/off operation, and the second switch element Q2 638 performs an operation opposite to the operation of the first switch element. At this point, the first switch element and the second switch element may be configured of at least any one of FET, BJT and SCR. In addition, a square-wave dimming signal generated by the second switch element is applied to the voltage apply module and converted to an analog power.

More specifically, if the PWM dimming signal is high H, a 3V signal is applied, and the first switch element Q1 635 is connected. If the first switch element is turned on, the gate voltage of the second switch element becomes zero, and the drain and source of the second switch element are in an open state. Accordingly, the 10V supply power of the supply power unit is applied to the voltage apply module as is, and the voltage apply module becomes 10V.

In addition, if the PWM dimming signal is low L, a 0V signal is applied, and the first switch element Q1 635 is not connected. If the first switch element is turned off, the gate voltage of the second switch element is applied, and the drain and source of the second switch element are in a short state. Accordingly, since the 10V supply power of the supply power unit is drained through the line of the short state, magnitude of the power applied to the voltage apply module becomes 0V.

The first resistor R1 632 is connected to the wireless signal input unit in series to perform a current control function according to the PWM dimming signal. The first capacitor C1 634 is connected to the first resistor in parallel to remove noise of the input PWM dimming signal. The zener diode 633 is connected to the first resistor in parallel to perform a clamping function when the applied voltage is higher than a predetermined level.

The second resistor R2 636 is connected to the output terminal of the first switch element in parallel to control magnitude of the voltage applied to the second switch element. The second capacitor C2 637 is connected to the output terminal of the first switch element in parallel to remove noise of a signal generated by the first switch element.

The third resistor R3 639 is connected between the output terminal of the first switch element and the supply power unit to apply the supply power (+10V) to the first switch element. The fourth resistor R4 is connected between the output terminal of the second switch element and the supply power unit to perform a function of dividing the supply power of the supply power unit according to setting of magnitude of the fifth resistor and the sixth resistor.

The voltage apply module 640 is used in both of the wireless module and the wired module and converts a square-wave dimming circuit (→ signal) generated by the second switch element to an analog power. The voltage apply module 640 may include a fifth resistor R5 641, a sixth resistor R6 642, a third capacitor C3 643 and a fourth capacitor C5 644.

The fifth resistor R5 641 is connected to the output terminal of the second switch element in series, and the sixth resistor R6 642 is connected to the fifth resistor in parallel. The fifth and sixth resistors perform a function of adjusting magnitude of the supply power of the supply power unit together with the fourth resistor.

The third capacitor C3 643 and the fourth capacitor C4 644 are connected to the fifth resistor in parallel to implement a circuit for smoothing a signal. Since the generated signal passing through the first and second switch elements may contain ripple voltage in the DC current compared with the input PWM dimming signal, a smoothing circuit should be implemented to reduce the ripples.

The wired module 610 inputs a wired dimming signal for controlling the lighting unit. At this point, the wired module may receive a 0 to 10V dimming signal. In addition, the wired module may include a wired signal input unit 611, a line filter 612, a diode 613 and a filter 614 and 615.

The wired signal input unit 611 receives the 0 to 10V dimming signal and applies the received dimming signal to the voltage module. In addition, the line filter 612 removes noise of the 0 to 10V dimming signal, and the filter 614 and 615 is also connected in series to remove noise. The diode 613 prevents reverse bias voltage of the voltage apply module. Since a reverse bias is generated and the circuit itself may be broken down if voltage is concentrated at the output, this can be prevented by including the diode in the wired signal input unit.

The voltage apply module 640 is also used for input of a wired signal, and the wired signal performs a function the same as that of the wireless dimming signal. The fifth and the sixth resistors adjust magnitude of supply voltage, and the third and fourth capacitors performs a function of a smoothing circuit for removing ripple voltage of the generated signal.

The lighting control apparatus using a wire and wireless integrated dimming circuit of the present invention simultaneously implements a 0 to 10V dimming circuit (wired) frequently used in the prior art and a wireless dimming circuit, it may be designed to drive the lighting control apparatus by selecting a dimming circuit by a customer or a consumer.

Further, the lighting control apparatus using a wire and wireless integrated dimming circuit of the present invention may be diversely applied according to diversity of an integrated circuit which controls dimming.

Further, the lighting control apparatus using a wire and wireless integrated dimming circuit of the present invention may quantitatively lower the unit price compared with a conventional 0 to 10V dimming circuit and may reduce a PCB size owing to simplification of the circuit.

Further, the lighting control apparatus using a wire and wireless integrated dimming circuit of the present invention mat selectively use a wired dimming circuit or a wireless dimming circuit according to the needs of a customer and may appeal to customers as a technical and differentiated product owing to a concept unused in the prior art.

The embodiments of the present invention described above are disclosed for illustrative purposes, and the present invention is not limited thereto. In addition, those skilled in the art may make diverse modifications and changes within the spirit and scope of the present invention, and all the modifications and changes should be regarded as belonging to the scope of the present invention.

What is claimed is:

1. A lighting control apparatus using a wire and wireless integrated dimming circuit, the lighting control apparatus comprising:

an input power supply unit;

a converter for converting input power to lighting unit supply power;

a lighting unit applied with the lighting unit supply power to emit light;

a wired module for inputting a wired dimming signal for controlling the lighting unit;

a wireless module for inputting a wireless dimming signal for controlling the lighting unit; and a transform module for receiving the wired dimming signal or the wireless dimming signal, transforming the received dimming signal to a preset power, and applying the transformed power to the converter, wherein the wired module and the wireless module are connected in parallel, selectively receive the wired dimming signal or the wireless dimming signal, and applies the received dimming signal to the transform module.

2. The lighting control apparatus according to claim 1, further comprising an EMI filter for removing noise of the input power and applying the input power to the converter.

3. The lighting control apparatus according to claim 1, wherein the converter includes:

a PFC converter; and a fly-back converter.

4. The lighting control apparatus according to claim 1, wherein the converter receives the wired dimming signal or the wireless dimming signal and controls dimming of the lighting unit if a necessary driving condition is satisfied.

5. The lighting control apparatus according to claim 1, wherein the wired module includes a wired signal input unit for inputting the wired dimming signal.

6. The lighting control apparatus according to claim 5, wherein the wired dimming signal is a 0 to 10V dimming signal.

7. The lighting control apparatus according to claim 1, wherein the wired module includes:

a first supply power unit; and a power distribution module for distributing supply power of the first supply power unit.

8. The lighting control apparatus according to claim 7, wherein the power distribution module includes:

a first wired resistor connected to a wired dimming signal input unit in series;

a second wired resistor connected to the wired dimming signal input unit in parallel;

a third wired resistor connected to the first wired resistor in series; and a fourth wired resistor connected to the third wired resistor in parallel.

9. The lighting control apparatus according to claim 7, wherein the wired module further includes:

an input filter module for removing noise of a wired dimming signal input; and an output filter module for removing noise of a wired dimming signal output.

10. The lighting control apparatus according to claim 1, wherein the wired module further includes a first diode for preventing reverse bias voltage.

11. The lighting control apparatus according to claim 1, wherein the wireless module receives a PWM dimming signal.

12. The lighting control apparatus according to claim 1, wherein the wireless module includes:

a second supply power unit;

a wireless signal input unit for inputting a wireless dimming signal;

a first switch element applied with the wireless dimming signal to perform an on/off operation; and a second switch element for performing an operation opposite to the operation of the first switch element and generating a dimming signal by the on/off operation.

13. The lighting control apparatus according to claim 12, wherein the wireless module includes:

a first wireless resistor connected to the wireless signal input unit in series;

a first wireless capacitor and a second wireless resistor connected to the first wireless resistor in parallel;

a third wireless resistor and a second wireless capacitor connected to an output terminal of the first switch element in parallel;

a fourth wireless resistor connected between the output terminal of the first switch element and the supply power unit; and a fifth wireless resistor connected between an output terminal of the second switch element and the supply power unit.

14. The lighting control apparatus according to claim 12, wherein the wireless module includes:

a sixth wireless resistor connected to an output terminal of the second switch element in series;

a seventh wireless resistor connected to the sixth wireless resistor in series;

a third wireless capacitor connected to the seventh wireless resistor in parallel;

an eighth wireless resistor connected between the sixth wireless resistor and the seventh wireless resistor in parallel; and a ninth wireless resistor connected to the eighth wireless resistor in series.

15. The lighting control apparatus according to claim 1, wherein the wireless module further includes a second diode for preventing reverse bias voltage.

16. The lighting control apparatus according to claim 1, wherein the transform module receives the wired dimming signal or the wireless dimming signal and transforms primary side power to secondary side power.

17. The lighting control apparatus according to claim 1, further comprising a standby module for generating a voltage for driving the converter.

* * * * *